US009150937B2

(12) United States Patent
Hung et al.

(10) Patent No.: US 9,150,937 B2
(45) Date of Patent: Oct. 6, 2015

(54) METHOD FOR PREPARING SUGARS

(71) Applicant: INDUSTRIAL TECHNOLOGY RESEARCH INSTITUTE, Hsinchu (TW)

(72) Inventors: Wei-Chun Hung, New Taipei (TW); Ruey-Fu Shih, New Taipei (TW); Jia-Yuan Chen, Hsinchu (TW); Hui-Tsung Lin, New Taipei (TW); Hom-Ti Lee, Zhubei (TW); Hou-Peng Wan, Guishan Township (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 14/151,018

(22) Filed: Jan. 9, 2014

(65) Prior Publication Data

US 2014/0216442 A1 Aug. 7, 2014

Related U.S. Application Data

(60) Provisional application No. 61/759,791, filed on Feb. 1, 2013.

(30) Foreign Application Priority Data

Sep. 26, 2013 (TW) ..... 102134699 A

(51) Int. Cl.
*C13K 1/02* (2006.01)
*C13K 1/04* (2006.01)

(52) U.S. Cl.
CPC .... *C13K 1/02* (2013.01); *C13K 1/04* (2013.01)

(58) Field of Classification Search
None
See application file for complete search history.

(56) References Cited

U.S. PATENT DOCUMENTS

| | | | | |
|---|---|---|---|---|
| 5,100,791 | A | 3/1992 | Spindler et al. | |
| 5,411,594 | A | 5/1995 | Brelsford | |
| 5,628,830 | A | 5/1997 | Brink | |
| 6,007,636 | A | 12/1999 | Lightner | |
| 6,022,419 | A | 2/2000 | Torget et al. | |
| 6,692,578 | B2 | 2/2004 | Schmidt et al. | |
| 7,666,637 | B2 | 2/2010 | Nguyen | |
| 8,003,352 | B2 | 8/2011 | Foody et al. | |
| 8,389,749 | B2 * | 3/2013 | Dumesic et al. | 549/489 |
| 2005/0096464 | A1 | 5/2005 | Heikkila et al. | |
| 2007/0112187 | A1 | 5/2007 | Heikkila et al. | |
| 2007/0125369 | A1 | 6/2007 | Olson et al. | |
| 2007/0148750 | A1 | 6/2007 | Hoshino et al. | |
| 2009/0042259 | A1 | 2/2009 | Dale et al. | |
| 2009/0170153 | A1 | 7/2009 | Stuart | |
| 2009/0221042 | A1 | 9/2009 | Dale et al. | |
| 2010/0069626 | A1 | 3/2010 | Kilambi | |
| 2010/0163019 | A1 | 7/2010 | Chornet et al. | |
| 2010/0175690 | A1 | 7/2010 | Nagahama et al. | |
| 2010/0240112 | A1 | 9/2010 | Anttila et al. | |
| 2011/0053239 | A1 | 3/2011 | Ray et al. | |
| 2011/0065159 | A1 | 3/2011 | Raines et al. | |
| 2011/0129886 | A1 * | 6/2011 | Howard et al. | 435/150 |
| 2011/0223643 | A1 | 9/2011 | Sun et al. | |
| 2011/0244499 | A1 | 10/2011 | Realff et al. | |
| 2011/0287493 | A1 | 11/2011 | Marzialetti et al. | |
| 2014/0090641 | A1 | 4/2014 | Shih et al. | |

FOREIGN PATENT DOCUMENTS

| | | | | |
|---|---|---|---|---|
| CA | 1100266 | A | | 5/1981 |
| CN | 101514349 | A | | 8/2009 |
| CN | 101855368 | A | | 10/2010 |
| CN | 102153763 | A | | 8/2011 |
| CN | 102174754 | A | | 9/2011 |
| CN | 101023179 | B | | 11/2011 |
| CN | 102417937 | A | | 4/2012 |
| CN | 102690897 | A | | 9/2012 |
| CN | 103710471 | A | | 4/2014 |
| CZ | 300865 | B6 | | 8/2009 |
| EP | 2336193 | A1 | | 6/2011 |
| EP | 2336195 | A1 | | 6/2011 |
| GB | 260650 | A | | 11/1926 |
| GB | 308322 | A | | 3/1929 |
| GB | 311695 | A | | 12/1929 |
| GB | 323693 | A | | 1/1930 |
| JP | 2010-98994 | A | | 5/2010 |
| JP | 2012005382 | A | * | 1/2012 |
| TW | 201139679 | A1 | | 11/2011 |
| WO | WO 2009/080737 | A2 | | 7/2009 |
| WO | WO 2011/097065 | A2 | | 8/2011 |
| WO | WO 2012/042545 | A1 | | 4/2012 |

OTHER PUBLICATIONS

Sun et al, Hydrolysis of Cotton Fiber Cellulose in Formic Acid, 2007, energy and fuels, vol. 21, pp. 2386-2389.*

English translation of JP2012005382.*

Alvira et al., "Pretreatment technologies for an efficient bioethanol production process based on enzymatic hydrolysis: A review", Bioresource Technology, vol. 101, 2010, pp. 4851-4861.

Amarasekara et al., "Hydrolysis and Decomposition of Cellulose in Bronsted Acidic Ionic Liquids Under Mild Conditions", American Chemical Society, Ind. Eng. Chem. Res., 2009, vol. 48, pp. 10152-10155.

Binder et al., "Fermentable sugars by chemical hydrolysis of biomass", PNAS, Mar. 9, 2010, vol. 107, No. 10, pp. 4516-4521.

Li et al., "Acid in ionic liquid: An efficient system for hydrolysis of lignocellulose", The Royal Society of Chemistry, Green Chem., vol. 10, 2008, pp. 177-182.

Maki-Arvela et al., "Dissolution of lignocellulosic materials and its constituents using ionic liquids-A review", Industrial Crops and Products, vol. 32, 2010, pp. 175-201.

(Continued)

*Primary Examiner* — Melvin C Mayes
*Assistant Examiner* — Stefanie Cohen
(74) *Attorney, Agent, or Firm* — Birch, Stewart, Kolasch & Birch, LLP

(57) ABSTRACT

In an embodiment of the present disclosure, a method for preparing a sugar is provided. The method includes mixing an organic acid and a solid acid catalyst to form a mixing solution, adding a cellulosic biomass to the mixing solution to proceed to a dissolution reaction, and adding water to the mixing solution to proceed to a hydrolysis reaction to obtain a sugar.

18 Claims, No Drawings

(56) References Cited

OTHER PUBLICATIONS

Shafiei et al., "Techno-economical study of ethanol and biogas from spruce wood by NMMO-pretreatment and rapid fermentation and digestion", Bioresource Technology, vol. 102, 2011, pp. 7879-7886.

Taiwan Notice of Allowance for Appl. No. 102134699 dated Nov. 24, 2014.

China Office Action dated May 6, 2015 for Appl. No. 201410005200.6.

* cited by examiner

METHOD FOR PREPARING SUGARS

CROSS REFERENCE TO RELATED APPLICATIONS

This application claims the benefit of U.S. Provisional Application No. 61/759,791, filed on Feb. 1, 2013, and priority of Taiwan Patent Application No. 102134699, filed on Sep. 26, 2013, the entireties of which are incorporated by reference herein.

TECHNICAL FIELD

The technical field relates to a method for preparing a sugar utilizing a solid acid catalyst.

BACKGROUND

The world is facing problems such as the gradual extraction and depletion of petroleum reserves, and changes to the earth's atmosphere due to the greenhouse effect. In order to ensure the sustainability of human life, it has become a world trend to gradually decrease the use of petrochemical energy and petroleum feedstock and to develop new sources of renewable energy and materials.

Lignocellulose is the main ingredient of biomass, which is the most abundant organic substance in the world. Lignocellulose mainly consists of 38-50% cellulose, 23-32% hemicellulose and 15-25% lignin. Cellulose generates glucose through hydrolysis. However, it is difficult for chemicals to enter the interior of cellulose molecules for depolymerization due to strong intermolecular and intramolecular hydrogen bonding and Van de Waal forces and the complex aggregate structure of cellulose with high-degree crystallinity. The main methods of hydrolyzing cellulose are enzyme hydrolysis and acid hydrolysis. However, there is significant imperfection in these two technologies, therefore, it is difficult to apply widely.

Generally speaking, enzyme hydrolysis can be carried out at room temperature, which is an environmentally friendly method due to the rarity of byproducts, no production of anti-sugar fermentation substances, and integration with the fermentation process. However, a complicated pretreatment process is required, hydrolytic activity is low, the reaction rate is slow, and cellulose hydrolysis enzyme is expensive.

Dilute acid hydrolysis generally uses comparatively cheap sulfuric acid as a catalyst, but it must operate in a corrosion-resistant pressure vessel at more than 200° C., requiring high-level equipment; simultaneously, the temperature of the dilute acid hydrolysis is high, the byproduct thereof is plentiful, and the sugar yield is low. Concentrated acid hydrolysis can operate at lower temperature and normal pressure. However, there are problems of strong corrosivity of concentrated acid, complications in the post-treatment process of the hydrolyzed solution, large consumption of acid, and difficulties with recycling, among other drawbacks.

SUMMARY

One embodiment of the disclosure provides a method for preparing a sugar, comprising: mixing an organic acid and a solid acid catalyst to form a mixing solution; adding a cellulosic biomass to the mixing solution to proceed to a dissolution reaction; and adding water to the mixing solution to proceed to a hydrolysis reaction to obtain a sugar.

A detailed description is given in the following embodiments.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In one embodiment of the disclosure, a method for preparing a sugar is provided, comprising the following steps. First, an organic acid and a solid acid catalyst are mixed to form a mixing solution. A cellulosic biomass is added to the mixing solution to proceed to a dissolution reaction. Water is added to the mixing solution to proceed to a hydrolysis reaction to obtain a sugar.

In one embodiment, the organic acid has a weight ratio of about 50-99 wt % in the mixing solution.

In one embodiment, the organic acid may comprise formic acid, acetic acid or a mixture thereof.

In one embodiment, the solid acid catalyst may comprise cation exchange resin, acidic zeolite, heteropoly acid or substances containing acidic functional groups with a carrier of silicon, silicon aluminum, titanium or activated carbon.

In one embodiment, the cation exchange resin may comprise Nafion or Amberlyst-35.

In one embodiment, the acidic zeolite may comprise ZSM5, HY-Zeolite, MCM-41 or mordenite zeolite.

In one embodiment, the heteropoly acid may comprise $H_3PW_{12}O_{40}$, $H_4SiW_{12}O_{40}$, $H_3PMo_{12}O_{40}$ or $R_4SiMo_{12}O_{40}$.

In one embodiment, the solid acid catalyst may comprise aluminum powder, iron oxide, silicon dioxide, titanium dioxide or tin dioxide.

In one embodiment, the solid acid catalyst has a weight ratio of about 1-50 wt % in the mixing solution, for example 10-35 wt %.

In one embodiment, the cellulosic biomass may comprise cellulose, hemicellulose, or lignin.

In one embodiment, the cellulosic biomass has a weight ratio of about 1-30 wt % in the mixing solution, for example 5-20 wt %.

In one embodiment, the cellulosic biomass may be derived from wood, grass, leaves, algae, waste paper, corn stalks, corn cobs, rice straw, rice husk, wheat straw, bagasse, bamboo, or crop stems.

In one embodiment, the dissolution reaction has a reaction temperature of about 40-130° C., for example 50-110° C.

In one embodiment, the dissolution reaction has a reaction time of about 20-360 minutes, for example 30-180 minutes.

In one embodiment, the amount of water added is greater than the total molar equivalent of monosaccharides hydrolyzed from the cellulosic biomass.

In one embodiment, the hydrolysis reaction has a reaction temperature of about 40-130° C., for example 50-110° C.

In one embodiment, the hydrolysis reaction has a reaction time of about 30-360 minutes, for example 60-180 minutes.

In one embodiment, the disclosed sugar preparation method further comprises separating the solid acid catalyst from the mixing solution through sedimentation, filtration or centrifugation.

EXAMPLES

Cellulose Dissolution Tests

Example 1-1

First, formic acid and solid titanium dioxide catalyst were mixed to form a mixing solution (89.7 wt % of formic acid, 10.3 wt % of titanium dioxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-2

First, formic acid and solid Nafion catalyst

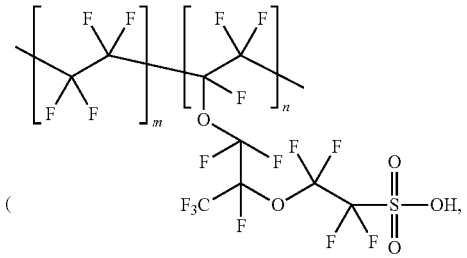

a strong acid-based polymer) were mixed to form a mixing solution (83.2 wt % of formic acid, 16.8 wt % of Nafion). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-3

First, formic acid and solid aluminum powder catalyst were mixed to form a mixing solution (91.67 wt % of formic acid, 8.33 wt % of aluminum powder). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-4

First, formic acid and solid silicon dioxide catalyst were mixed to form a mixing solution (91.67 wt % of formic acid, 8.33 wt % of silicon dioxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-5

First, formic acid and solid HY-Zeolite catalyst were mixed to form a mixing solution (91.67 wt % of formic acid, 8.33 wt % of HY-Zeolite). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-6

First, formic acid and solid ZSM5 catalyst were mixed to form a mixing solution (91.67 wt % of formic acid, 8.33 wt % of ZSM5). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-7

First, formic acid and solid tin dioxide catalyst were mixed to form a mixing solution (91.67 wt % of formic acid, 8.33 wt % of tin dioxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-8

First, formic acid and solid Amberlyst-35 catalyst were mixed to form a mixing solution (91.67 wt % of formic acid, 8.33 wt % of Amberlyst-35). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-9

First, formic acid and solid iron oxide catalyst were mixed to form a mixing solution (91.69 wt % of formic acid, 8.31 wt % of iron oxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 1.

Example 1-10

First, formic acid and solid heteropoly acid ($H_3PW_{12}O_{40}$) catalyst were mixed to form a mixing solution (99.0 wt % of formic acid, 1 wt % of heteropoly acid ($H_3PW_{12}O_{40}$)). Next, Avicel® cellulose (Sigma Corporation, Avicel-pH-105-27NI) was added to the mixing solution (5 wt % of Avicel® cellulose) to proceed to a dissolution reaction (70° C., 120 minutes). The result was recorded in Table 1.

Example 1-11

First, formic acid and solid catalyst with a carrier of activated carbon were mixed to form a mixing solution (84.1 wt % of formic acid, 15.9 wt % of solid catalyst with a carrier of activated carbon). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 1.

TABLE 1

| | Solvent | Catalyst | Catalyst content (wt %) | Temp (° C.) | Time (min) | Solution appearance | Filtrate color | Results |
|---|---|---|---|---|---|---|---|---|
| 1-1 | Formic acid | Titanium dioxide | 10.3 | 80-85 | 240 | White powder | Pale yellow | Dissolution |
| 1-2 | | Nafion | 16.8 | | | White powder | Pale yellow | Dissolution |
| 1-3 | | Aluminum powder | 8.33 | | | Silver powder | Orange | Dissolution |
| 1-4 | | Silicon dioxide | 8.33 | | | White powder | Yellow | Dissolution |
| 1-5 | | HY-Zeolite | 8.33 | | | White powder | Pale yellow | Dissolution |
| 1-6 | | ZSM5 | 8.33 | | | White powder | Yellow | Dissolution |
| 1-7 | | Tin dioxide | 8.33 | | | White powder | Yellow | Dissolution |
| 1-8 | | Amberlyst-35 | 8.33 | | | White powder/ black particle | Yellow | Dissolution |
| 1-9 | | Iron oxide | 8.31 | | | Dark red | Yellow | Dissolution |
| 1-10 | | Heteropoly acid ($H_3PW_{12}O_{40}$) | 1 | 70 | 120 | White powder | Yellow | Dissolution |
| 1-11 | | Solid catalyst with a carrier of activated carbon | 15.9 | 80-85 | 180 | White powder/ black particle | Colorless | Undissolution |

Example 1-12

First, formic acid and solid titanium dioxide catalyst were mixed to form a mixing solution (79.4 wt % of formic acid, 20.6 wt % of titanium dioxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-13

First, formic acid and solid Nafion catalyst

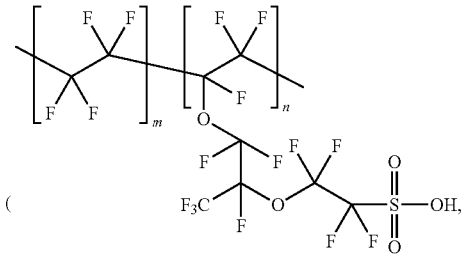

a strong acid-based polymer) were mixed to form a mixing solution (91.6 wt % of formic acid, 8.4 wt % of Nafion). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-14

First, formic acid and solid aluminum powder catalyst were mixed to form a mixing solution (93.33 wt % of formic acid, 6.67 wt % of aluminum powder). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-15

First, formic acid and solid aluminum powder catalyst were mixed to form a mixing solution (66.7 wt % of formic acid, 33.3 wt % of aluminum powder). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-16

First, formic acid and solid silicon dioxide catalyst were mixed to form a mixing solution (69.2 wt % of formic acid, 30.8 wt % of silicon dioxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-17

First, formic acid and solid HY-Zeolite catalyst were mixed to form a mixing solution (84.4 wt % of formic acid, 15.6 wt % of HY-Zeolite). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-18

First, formic acid and solid ZSM5 catalyst were mixed to form a mixing solution (84.4 wt % of formic acid, 15.6 wt % of ZSM5). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-19

First, formic acid and solid tin dioxide catalyst were mixed to form a mixing solution (66.7 wt % of formic acid, 33.3 wt % of tin dioxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-20

First, formic acid and solid Amberlyst-35 catalyst were mixed to form a mixing solution (66.3 wt % of formic acid, 33.7 wt % of Amberlyst-35). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-21

First, formic acid and solid iron oxide catalyst were mixed to form a mixing solution (83.4 wt % of formic acid, 16.6 wt % of iron oxide). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 2.

Example 1-22

First, formic acid and solid heteropoly acid ($H_3PW_{12}O_{40}$) catalyst were mixed to form a mixing solution (5.0 wt % of formic acid, 5 wt % of heteropoly acid ($H_3PW_{12}O_{40}$)). Next, Avicel® cellulose (Sigma Corporation, Avicel-pH-105-27NI) was added to the mixing solution (5 wt % of Avicel® cellulose) to proceed to a dissolution reaction (70° C., 120 minutes). The result was recorded in Table 2.

Example 1-23

First, formic acid and solid catalyst with a carrier of activated carbon were mixed to form a mixing solution (70.9 wt % of formic acid, 29.1 wt % of solid catalyst with a carrier of activated carbon). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 2.

TABLE 2

| | Solvent | Catalyst | Catalyst content (wt %) | Temp (° C.) | Time (min) | Solution appearance | Filtrate color | Results |
|---|---|---|---|---|---|---|---|---|
| 1-12 | Formic acid | Titanium dioxide | 20.6 | 80-85 | 240 | White powder | Pale yellow | Dissolution |
| 1-13 | | Nafion | 8.4 | | | White powder | Pale yellow | Dissolution |
| 1-14 | | Aluminum powder | 6.67 | | | Silver powder | Orange | Dissolution |
| 1-15 | | Aluminum powder | 33.3 | | | Silver powder | Orange | Dissolution |
| 1-16 | | Silicon dioxide | 30.8 | | | White powder | Yellow | Dissolution |
| 1-17 | | HY-Zeolite | 15.6 | | | White powder | Pale yellow | Dissolution |
| 1-18 | | ZSM5 | 15.6 | | | White powder | Yellow | Dissolution |
| 1-19 | | Tin dioxide | 33.3 | | | White powder | Yellow | Dissolution |
| 1-20 | | Amberlyst-35 | 33.7 | | | White powder/ black particle | Yellow | Dissolution |
| 1-21 | | Iron oxide | 16.6 | | | Dark red | Yellow | Dissolution |
| 1-22 | | Heteropoly acid ($H_3PW_{12}O_{40}$) | 5 | 70 | 120 | Yellow powder | Orange | Dissolution |
| 1-23 | | Solid catalyst with a carrier of activated carbon | 29.1 | 80-85 | 180 | White powder/ black particle | Yellow | Dissolution |

Example 1-24

First, formic acid and solid titanium dioxide catalyst were mixed to form a mixing solution (89.7 wt % of formic acid, 10.3 wt % of titanium dioxide). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-25

First, formic acid and solid Nafion catalyst

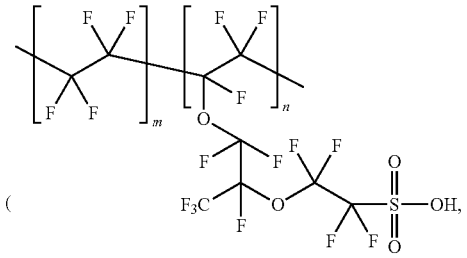

a strong acid-based polymer) were mixed to form a mixing solution (83.2 wt % of formic acid, 16.8 wt % of Nafion). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-26

First, formic acid and solid aluminum powder catalyst were mixed to form a mixing solution (66.7 wt % of formic acid, 33.3 wt % of aluminum powder). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-27

First, formic acid and solid silicon dioxide catalyst were mixed to form a mixing solution (69.2 wt % of formic acid, 30.8 wt % of silicon dioxide). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-28

First, formic acid and solid silicon dioxide catalyst were mixed to form a mixing solution (91.9 wt % of formic acid, 8.1 wt % of silicon dioxide). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-29

First, formic acid and solid HY-Zeolite catalyst were mixed to form a mixing solution (84.4 wt % of formic acid, 15.6 wt % of HY-Zeolite). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-30

First, formic acid and solid ZSM5 catalyst were mixed to form a mixing solution (84.4 wt % of formic acid, 15.6 wt % of ZSM5). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-31

First, formic acid and solid tin dioxide catalyst were mixed to form a mixing solution (66.3 wt % of formic acid, 33.7 wt % of tin dioxide). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-32

First, formic acid and solid Amberlyst-35 catalyst were mixed to form a mixing solution (79.9 wt % of formic acid, 20.1 wt % of Amberlyst-35). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-33

First, formic acid and solid Amberlyst-35 catalyst were mixed to form a mixing solution (66.3 wt % of formic acid, 33.7 wt % of Amberlyst-35). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-34

First, formic acid and solid iron oxide catalyst were mixed to form a mixing solution (91.69 wt % of formic acid, 8.31 wt % of iron oxide). Next, Avicel® cellulose (Sigma Corporation, Avicel-pH-105-27NI) was added to the mixing solution (5 wt % of Avicel® cellulose) to proceed to a dissolution reaction (101° C., 240 minutes). The result was recorded in Table 3.

Example 1-35

First, formic acid and solid heteropoly acid ($H_3PW_{12}O_{40}$) catalyst were mixed to form a mixing solution (99.0 wt % of formic acid, 1 wt % of heteropoly acid ($H_3PW_{12}O_{40}$)). Next, Avicel® cellulose (Sigma Corporation, Avicel-pH-105-27NI) was added to the mixing solution (5 wt % of Avicel® cellulose) to proceed to a dissolution reaction (95, 120 minutes). The result was recorded in Table 3.

Example 1-36

First, formic acid and solid catalyst with a carrier of activated carbon were mixed to form a mixing solution (73.1 wt % of formic acid, 26.9 wt % of solid catalyst with a carrier of activated carbon). Next, Avicel® cellulose (Sigma Corporation, Avicel-pH-105-27NI) was added to the mixing solution (5 wt % of Avicel® cellulose) to proceed to a dissolution reaction (95° C., 180 minutes). The result was recorded in Table 3.

TABLE 3

| | Solvent | Catalyst | Catalyst content (wt %) | Temp (° C.) | Time (min) | Solution appearance | Filtrate color | Results |
|---|---|---|---|---|---|---|---|---|
| 1-24 | Formic acid | Titanium dioxide | 10.3 | 101 | 240 | White powder | Pale yellow | Dissolution |
| 1-25 | | Nafion | 16.8 | | | White powder | Pale yellow | Dissolution |
| 1-26 | | Aluminum powder | 33.3 | | | Silver powder | Orange | Dissolution |
| 1-27 | | Silicon dioxide | 30.8 | | | Silver powder | Orange | Dissolution |
| 1-28 | | Silicon dioxide | 8.1 | | | White powder | Yellow | Dissolution |
| 1-29 | | HY-Zeolite | 15.6 | | | White powder | Pale yellow | Dissolution |
| 1-30 | | ZSM5 | 15.6 | | | White powder | Yellow | Dissolution |
| 1-31 | | Tin dioxide | 33.7 | | | White powder | Yellow | Dissolution |
| 1-32 | | Amberlyst-35 | 20.1 | | | White powder/ black particle | Yellow | Dissolution |
| 1-33 | | Amberlyst-35 | 33.7 | | | White powder/ black particle | Yellow | Dissolution |
| 1-34 | | Iron oxide | 8.31 | | | Dark red | Yellow | Dissolution |
| 1-35 | | Heteropoly acid ($H_3PW_{12}O_{40}$) | 1 | 95 | 120 | Yellow powder | Yellow | Dissolution |
| 1-36 | | Solid catalyst with a carrier of activated carbon | 26.9 | 95 | 180 | White powder/ black particle | Yellow | Dissolution |

Example 1-37

First, formic acid and solid titanium dioxide catalyst were mixed to form a mixing solution (89.7 wt % of formic acid, 10.3 wt % of titanium dioxide). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-38

First, formic acid and solid Nafion catalyst

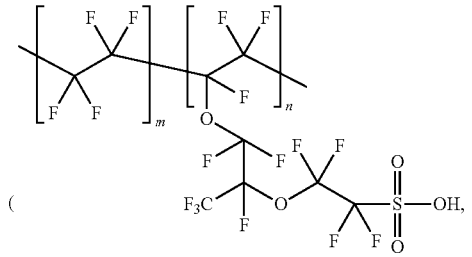

a strong acid-based polymer) were mixed to form a mixing solution (91.6 wt % of formic acid, 8.4 wt % of Nafion). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-39

First, formic acid and solid aluminum powder catalyst were mixed to form a mixing solution (91.67 wt % of formic acid, 8.33 wt % of aluminum powder). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-40

First, formic acid and solid silicon dioxide catalyst were mixed to form a mixing solution (91.67 wt % of formic acid, 8.33 wt % of silicon dioxide). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-41

First, formic acid and solid HY-Zeolite catalyst were mixed to form a mixing solution (91.67 wt % of formic acid, 8.33 wt % of HY-Zeolite). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-42

First, formic acid and solid ZSM5 catalyst were mixed to form a mixing solution (91.67 wt % of formic acid, 8.33 wt % of ZSM5). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-43

First, formic acid and solid tin dioxide catalyst were mixed to form a mixing solution (91.67 wt % of formic acid, 8.33 wt % of tin dioxide). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-44

First, formic acid and solid Amberlyst-35 catalyst were mixed to form a mixing solution (91.67 wt % of formic acid, 8.33 wt % of Amberlyst-35). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-45

First, formic acid and solid iron oxide catalyst were mixed to form a mixing solution (91.69 wt % of formic acid, 8.31 wt % of iron oxide). Next, Avicel® cellulose (Sigma Corporation, Avicel-pH-105-27NI) was added to the mixing solution (5 wt % of Avicel® cellulose) to proceed to a dissolution reaction (80-85° C., 180 minutes). The result was recorded in Table 4.

Example 1-46

First, formic acid and solid heteropoly acid ($H_3PW_{12}O_{40}$) catalyst were mixed to form a mixing solution (99.0 wt % of formic acid, 1 wt % of heteropoly acid ($H_3PW_{12}O_{40}$)). Next, Avicel® cellulose (Sigma Corporation, Avicel-pH-105-27NI) was added to the mixing solution (5 wt % of Avicel® cellulose) to proceed to a dissolution reaction (70° C., 60 minutes). The result was recorded in Table 4.

Example 1-47

First, formic acid and solid catalyst with a carrier of activated carbon were mixed to form a mixing solution (73.1 wt % of formic acid, 26.9 wt % of solid catalyst with a carrier of activated carbon). Next, Avicel® cellulose (Sigma Corporation, Avicel-pH-105-27NI) was added to the mixing solution (5 wt % of Avicel® cellulose) to proceed to a dissolution reaction (80-85° C., 240 minutes). The result was recorded in Table 4.

TABLE 4

| | Solvent | Catalyst | Catalyst content (wt %) | Temp (° C.) | Time (min) | Solution appearance | Filtrate color | Results |
|---|---|---|---|---|---|---|---|---|
| 1-37 | Formic acid | Titanium dioxide | 10.3 | 80-85 | 180 | White powder | Colorless | Dissolution |
| 1-38 | | Nafion | 8.4 | | | White powder | Pale yellow | Dissolution |
| 1-39 | | Aluminum powder | 8.33 | | | Silver powder | Yellow | Dissolution |
| 1-40 | | Silicon dioxide | 8.33 | | | White powder | Yellow | Dissolution |
| 1-41 | | HY-Zeolite | 8.33 | | | White powder | Pale yellow | Dissolution |
| 1-42 | | ZSM5 | 8.33 | | | White powder | Pale yellow | Dissolution |
| 1-43 | | Tin dioxide | 8.33 | | | White powder | Yellow | Dissolution |
| 1-44 | | Amberlyst-35 | 8.33 | | | White powder/ black particle | Yellow | Dissolution |
| 1-45 | | Iron Oxide | 8.31 | | | Orange | Yellow | Dissolution |
| 1-46 | | Heteropoly acid ($H_3PW_{12}O_{40}$) | 1 | 70 | 60 | Yellow powder | Yellow | Dissolution |
| 1-47 | | Solid catalyst with a carrier of activated carbon | 26.9 | 80-85 | 240 | White powder/ black particle | Yellow | Dissolution |

Example 1-48

First, formic acid and solid titanium dioxide catalyst were mixed to form a mixing solution (89.7 wt % of formic acid, 10.3 wt % of titanium dioxide). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-49

First, formic acid and solid Nafion catalyst

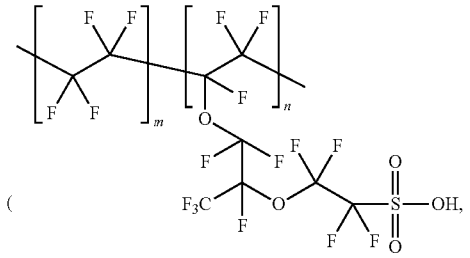

a strong acid-based polymer) were mixed to form a mixing solution (91.6 wt % of formic acid, 8.4 wt % of Nafion). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-50

First, formic acid and solid aluminum powder catalyst were mixed to form a mixing solution (91.67 wt % of formic acid, 8.33 wt % of aluminum powder). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-51

First, formic acid and solid silicon dioxide catalyst were mixed to form a mixing solution (91.67 wt % of formic acid, 8.33 wt % of silicon dioxide). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-52

First, formic acid and solid HY-Zeolite catalyst were mixed to form a mixing solution (91.67 wt % of formic acid, 8.33 wt % of HY-Zeolite). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-53

First, formic acid and solid ZSM5 catalyst were mixed to form a mixing solution (91.67 wt % of formic acid, 8.33 wt % of ZSM5). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-54

First, formic acid and solid tin dioxide catalyst were mixed to form a mixing solution (91.67 wt % of formic acid, 8.33 wt % of tin dioxide). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-55

First, formic acid and solid Amberlyst-35 catalyst were mixed to form a mixing solution (91.67 wt % of formic acid, 8.33 wt % of Amberlyst-35). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-56

First, formic acid and solid iron oxide catalyst were mixed to form a mixing solution (91.69 wt % of formic acid, 8.31 wt % of iron oxide). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

Example 1-57

First, formic acid and solid heteropoly acid ($H_3PW_{12}O_{40}$) catalyst were mixed to form a mixing solution (99.0 wt % of formic acid, 1 wt % of heteropoly acid ($H_3PW_{12}O_{40}$)). Next, Avicel® cellulose (Sigma Corporation, Avicel-pH-105-27NI) was added to the mixing solution (5 wt % of Avicel® cellulose) to proceed to a dissolution reaction (70° C., 300 minutes). The result was recorded in Table 5.

Example 1-58

First, formic acid and solid catalyst with a carrier of activated carbon were mixed to form a mixing solution (73.1 wt % of formic acid, 26.9 wt % of solid catalyst with a carrier of activated carbon). Next, Avicel® cellulose (Sigma Corporation, Avicel-pH-105-27NI) was added to the mixing solution (5 wt % of Avicel® cellulose) to proceed to a dissolution reaction (80-85° C., 360 minutes). The result was recorded in Table 5.

TABLE 5

| | Solvent | Catalyst | Catalyst content (wt %) | Temp (° C.) | Time (min) | Solution appearance | Filtrate color | Results |
|---|---|---|---|---|---|---|---|---|
| 1-48 | Formic acid | Titanium dioxide | 10.3 | 80-85 | 360 | White powder | Pale yellow | Dissolution |
| 1-49 | | Nafion | 8.4 | | | White powder | Pale yellow | Dissolution |
| 1-50 | | Aluminum powder | 8.33 | | | Silver powder | Orange | Dissolution |
| 1-51 | | Silicon dioxide | 8.33 | | | White powder | Yellow | Dissolution |
| 1-52 | | HY-Zeolite | 8.33 | | | White powder | Pale yellow | Dissolution |
| 1-53 | | ZSM5 | 8.33 | | | White powder | Yellow | Dissolution |
| 1-54 | | Tin dioxide | 8.33 | | | White powder | Yellow | Dissolution |
| 1-55 | | Amberlyst-35 | 8.33 | | | White powder/ black particle | Yellow | Dissolution |

TABLE 5-continued

| | Solvent | Catalyst | Catalyst content (wt %) | Temp (° C.) | Time (min) | Solution appearance | Filtrate color | Results |
|---|---|---|---|---|---|---|---|---|
| 1-56 | | Iron Oxide | 8.31 | | | Dark red | Yellow | Dissolution |
| 1-57 | | Heteropoly acid ($H_3PW_{12}O_{40}$) | 1 | 70 | 300 | White powder | Orange | Dissolution |
| 1-58 | | Solid catalyst with a carrier of activated carbon | 26.9 | 80-85 | 360 | White powder/ black particle | Yellow | Dissolution |

Cellulose Hydrolysis Tests

Example 2-1

5 wt % of cellulose was soaked in a formic acid solution for 16 hours. 15.6 wt % of solid Amberlyst-35 catalyst was added to the formic acid solution and reacted for 3 hours under reflux conditions. Water (50% of the weight of the reaction mixture) and an additional 15.6 wt % of solid Amberlyst-35 catalyst (about 17 g) were added to the reaction solution and heated to 100° C. to proceed to a first hydrolysis reaction to form a first hydrolyzed solution. The first hydrolyzed solution was sampled 1-2 g at the $0^{th}$, $30^{th}$, $60^{th}$ and $90^{th}$ minute, respectively. After filtering the solid catalyst out, water (50% of the weight of the reaction mixture) was added to the first hydrolyzed solution and heated to 100° C. to proceed to a second hydrolysis reaction to form a second hydrolyzed solution. The second hydrolyzed solution was sampled 1-2 g at the $60^{th}$ and $120^{th}$ minute, respectively. The total weight of the reducing sugar of the above-mentioned samples was measured using 3,5-dinitro-salicylic acid (DNS) method. The content of glucose was measured using high performance liquid chromatography (HPLC). The yield of the glucose was 78.8%. The yield of the reducing sugar was 83.2%. The reducing sugar comprised glucose, xylose, mannose, arabinose and oligosaccharides thereof.

Example 2-2

5 wt % of cellulose and 20.6 wt % of solid titanium dioxide catalyst were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $120^{th}$ minute. The total weight of the reducing sugar of the sample was measured using 3,5-dinitro-salicylic acid (DNS) method. The content of glucose was measured using high performance liquid chromatography (HPLC). The yield of the glucose was 11.6%. The yield of the reducing sugar was 18.6%.

Example 2-3

5 wt % of cellulose and 8.4 wt % of solid Nafion catalyst were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $180^{th}$ minute. The total weight of the reducing sugar of the sample was measured using 3,5-dinitro-salicylic acid (DNS) method. The content of glucose was measured using high performance liquid chromatography (HPLC). The yield of the glucose was 15.4%. The yield of the reducing sugar was 21.4%.

Example 2-4

5 wt % of cellulose and 20.3 wt % of solid aluminum powder catalyst were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $90^{th}$ minute. The total weight of the reducing sugar of the sample was measured using 3,5-dinitro-salicylic acid (DNS) method. The content of glucose was measured using high performance liquid chromatography (HPLC). The yield of the glucose was 3.7%. The yield of the reducing sugar was 19.0%.

Example 2-5

5 wt % of cellulose and 8.33 wt % of solid silicon dioxide catalyst were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $180^{th}$ minute. The total weight of the reducing sugar of the sample was measured using 3,5-dinitro-salicylic acid (DNS) method. The content of glucose was measured using high performance liquid chromatography (HPLC). The yield of the glucose was 4.0%. The yield of the reducing sugar was 6.9%.

Example 2-6

5 wt % of cellulose and 15.6 wt % of solid HY-Zeolite catalyst were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $180^{th}$ minute. The total weight of the reducing sugar of the sample was measured using 3,5-dinitro-salicylic acid (DNS) method. The content of glucose was measured using high performance liquid chromatography (HPLC). The yield of the glucose was 12.8%. The yield of the reducing sugar was 25.2%.

Example 2-7

10 wt % of cellulose and 15.6 wt % of solid ZSM5 catalyst were added to a formic acid solution and reacted for 6 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $90^{th}$ minute. The total weight of the reducing sugar of the sample was measured using 3,5-dinitro-salicylic acid (DNS) method. The content of glucose was measured using high performance liquid chromatography (HPLC). The yield of the glucose was 18.4%. The yield of the reducing sugar was 31.9%.

Example 2-8

5 wt % of cellulose and 8.33 wt % of solid tin dioxide catalyst were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $120^{th}$ minute. The total weight of the reducing sugar of the sample was measured using 3,5-dinitro-salicylic acid (DNS) method. The content of glucose was measured using high performance liquid chromatography (HPLC). The yield of the glucose was 11.2%. The yield of the reducing sugar was 20.2%.

Example 2-9

5 wt % of cellulose and 16.6 wt % of solid iron oxide catalyst were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $240^{th}$ minute. The total weight of the reducing sugar of the sample was measured using 3,5-dinitro-salicylic acid (DNS) method. The content of glucose was measured using high performance liquid chromatography (HPLC). The yield of the glucose was 15.2%. The yield of the reducing sugar was 20.6%.

Example 2-10

5 wt % of cellulose and 5.0 wt % of solid heteropoly acid ($H_3PW_{12}O_{40}$) catalyst were added to a formic acid solution and reacted for 3 hours under reflux conditions. Water (50% of the weight of the reaction mixture) was added to the reaction solution and heated to 100° C. to proceed to a first hydrolysis reaction to form a first hydrolyzed solution. After filtering the solid catalyst out at the $90^{th}$ minute, water (50% of the weight of the reaction mixture) was added to the first hydrolyzed solution and heated to 100° C. to proceed to a second hydrolysis reaction to form a second hydrolyzed solution. The second hydrolyzed solution was sampled 1-2 g at the $90^{th}$ minute. The total weight of the reducing sugar of the sample was measured using 3,5-dinitro-salicylic acid (DNS) method. The content of glucose was measured using high performance liquid chromatography (HPLC). The yield of the glucose was 48.4%. The yield of the reducing sugar was 55.2%.

Example 2-11

5 wt % of cellulose and 18.5 wt % of solid catalyst with a carrier of activated carbon were added to a formic acid solution and reacted for 3 hours under reflux conditions. Water (50% of the weight of the reaction mixture) was added to the reaction solution and heated to 100° C. to proceed to a hydrolysis reaction to form a hydrolyzed solution. The hydrolyzed solution was sampled 1-2 g at the $120^{th}$ minute. The total weight of the reducing sugar of the sample was measured using 3,5-dinitro-salicylic acid (DNS) method. The content of glucose was measured using high performance liquid chromatography (HPLC). The yield of the glucose was 43.5%. The yield of the reducing sugar was 49.3%.

In the present disclosure, formic acid is adopted, on a condition of high sugar yield, a solid acid catalyst is adopted, and a cellulosic biomass is esterified and dissolved in the formic acid solution at a temperature lower than 130° C. within 6 hours, and then water is added to the reaction solution to proceed to a hydrolysis reaction at a temperature lower than 130° C. within 6 hours to obtain a sugar product.

The present disclosure replaces a liquid homogeneous catalyst with a solid acid catalyst. After the cellulosic biomass is esterified and dissolved in the formic acid solution, water is added at an appropriate temperature to transfer the reactants into sugar products. The solid catalyst is recovered and reused through the low-cost and low-energy consumption filtration method.

The present disclosure adopts a simple filtration method to separate and recover the solid catalyst. The conventional method of recovery of liquid catalyst is more complicated and has higher energy consumption. The present disclosure adopts the solid acid catalyst without use of any corrosion-resistant reactor with special material while the conventional liquid catalyst is corrosive. In addition, the hydrolysis reaction time provided by the present disclosure is pretty fast which is only one-fifth of that provided by the conventional enzyme hydrolysis.

It will be apparent to those skilled in the art that various modifications and variations can be made to the disclosed embodiments. It is intended that the specification and examples be considered as exemplary only, with the true scope of the disclosure being indicated by the following claims and their equivalents.

What is claimed is:

1. A method for preparing a sugar, comprising:

(1) mixing an organic acid and a solid acid catalyst to form a mixing solution;

(2) adding a cellulosic biomass to the mixing solution of (1) containing the organic acid and the solid acid catalyst to esterify and dissolve the cellulosic biomass; and (3) adding water after the cellulosic biomass has been esterified and dissolved in (2) to the mixing solution to proceed to a hydrolysis reaction to obtain a sugar.

2. The method for preparing a sugar as claimed in claim 1, wherein the organic acid has a weight ratio of 50-99 wt % in the mixing solution.

3. The method for preparing a sugar as claimed in claim 1, wherein the organic acid comprises formic acid, acetic acid or a mixture thereof.

4. The method for preparing a sugar as claimed in claim 1, wherein the solid acid catalyst comprises cation exchange resin, acidic zeolite, heteropoly acid or substances containing acidic functional groups with a carrier of silicon, silicon aluminum, titanium or activated carbon.

5. The method for preparing a sugar as claimed in claim 1, wherein the solid acid catalyst comprises aluminum powder, iron oxide, silicon dioxide, titanium dioxide or tin dioxide.

6. The method for preparing a sugar as claimed in claim 4, wherein the cation exchange resin comprises a material structure represented by

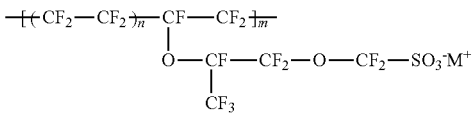

where $M^+$is a counter ion of $H^+$, $Li^+$ or $Na^+$ sold under the trademark Nafion or

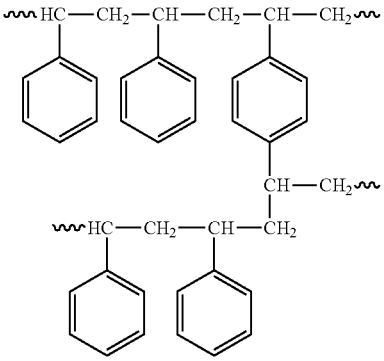

phenyl groups are further sulfonated at the para position thereof sold under the trademark Amberlyst-3 5.

7. The method for preparing a sugar as claimed in claim 4, wherein the acidic zeolite comprises ZSM5, HY-Zeolite, MCM-41 or mordenite zeolite.

8. The method for preparing a sugar as claimed in claim 4, wherein the heteropoly acid comprises $H_3PW_{12}O_{40}$, $H_4SiW_{12}O_{40}$, $H_3PMo_{12}O_{40}$ or $H_4SiMo_{12}O_{40}$.

9. The method for preparing a sugar as claimed in claim 1, wherein the solid acid catalyst has a weight ratio of 1-50 wt % in the mixing solution.

10. The method for preparing a sugar as claimed in claim 1, wherein the cellulosic biomass comprises cellulose, hemicellulose or lignin.

11. The method for preparing a sugar as claimed in claim 1, wherein the cellulosic biomass has a weight ratio of 1-30 wt % in the mixing solution.

12. The method for preparing a sugar as claimed in claim 1, wherein the cellulosic biomass is derived from wood, grass, leaves, algae, waste paper, corn stalks, corn cobs, rice straw, rice husk, wheat straw, bagasse, bamboo or crop stems.

13. The method for preparing a sugar as claimed in claim 1, wherein the dissolution reaction has a reaction temperature of 40-130° C.

14. The method for preparing a sugar as claimed in claim 1, wherein the dissolution reaction has a reaction time of 20-360 minutes.

15. The method for preparing a sugar as claimed in claim 1, wherein the amount of water added is greater than the total molar equivalent of monosaccharides hydrolyzed from the cellulosic biomass.

16. The method for preparing a sugar as claimed in claim 1, wherein the hydrolysis reaction has a reaction temperature of 40-130° C.

17. The method for preparing a sugar as claimed in claim 1, wherein the hydrolysis reaction has a reaction time of 30-360 minutes.

18. The method for preparing a sugar as claimed in claim 1 claim 1, further comprising separating the solid acid catalyst from the mixing solution through sedimentation, filtration or centrifugation.

* * * * *